United States Patent [19]

Clayton et al.

[11] 4,179,270

[45] Dec. 18, 1979

[54] AID FOR KINDLING FIRES

[75] Inventors: William J. Clayton, Fairport; Donald F. Kutniewski, Macedon, both of N.Y.

[73] Assignee: Mobil Oil Corporation, New York, N.Y.

[21] Appl. No.: 928,340

[22] Filed: Jul. 27, 1978

[51] Int. Cl.[2] ..... C10L 11/00

[52] U.S. Cl. ..... 44/40; 44/41; 206/204

[58] Field of Search ..... 44/38, 40, 41; 53/400; 206/204

[56] References Cited

U.S. PATENT DOCUMENTS

| | | | |
|---|---|---|---|
| 196,656 | 10/1877 | Gotham | 44/38 |
| 390,610 | 10/1888 | MacBrair | 44/41 |
| 617,424 | 1/1899 | Pflaum | 44/38 |
| 1,484,302 | 2/1924 | Garrett | 44/34 |
| 1,767,293 | 6/1930 | Krei et al. | 44/34 |
| 2,007,694 | 7/1935 | Rutherford | 44/41 |
| 2,107,054 | 2/1938 | Haymond | 44/41 |
| 2,240,335 | 4/1941 | Keil | 44/40 |
| 2,622,017 | 12/1952 | Bramhall et al. | 44/40 |
| 2,799,563 | 7/1957 | Shenker | 44/40 |
| 3,846,086 | 11/1974 | Balch et al. | 44/40 |

*Primary Examiner*—Carl Dees

*Attorney, Agent, or Firm*—Charles A. Huggett; Ronald J. Cier

[57] ABSTRACT

There is disclosed herein a clean burning, non-volatile device useful for the ignition of fires in combustible medium such as charcoal briquettes. The device comprises a core composed of wax and cellulosic particles (e.g. sawdust), together with an adjacent absorbant material to take up any oily exudate from the core. The core and absorbant material, with an optional lighter strip for conveying a flame to the core, are enclosed in a flammable, oil impervious container. In use, the device is placed on the combustible medium and the container ignited. The flame is conveyed to the core composition of the device, which in turn burns with sufficient vigor and for a sufficient length of time to kindle a fire in the combustible medium.

9 Claims, 2 Drawing Figures

Figure 1
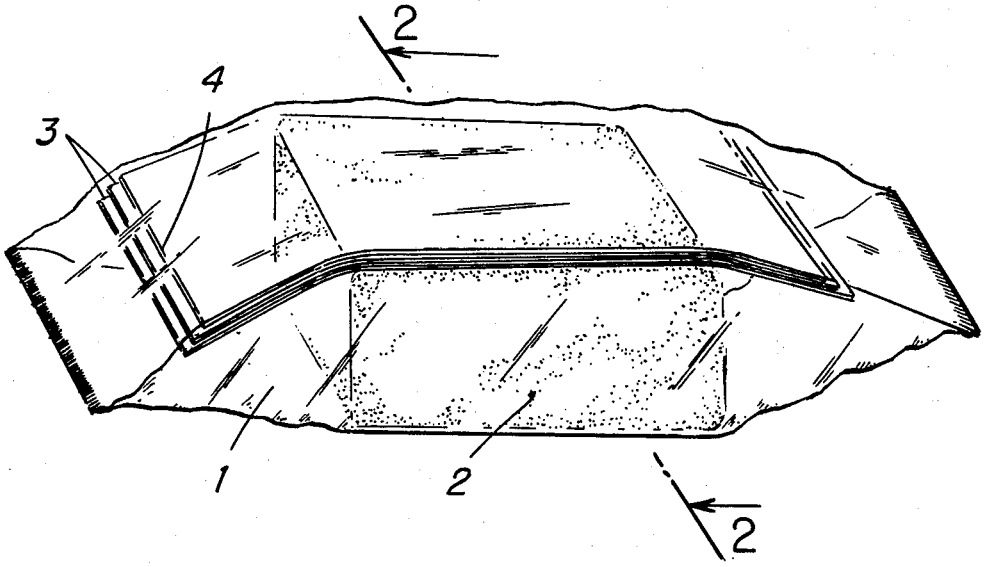
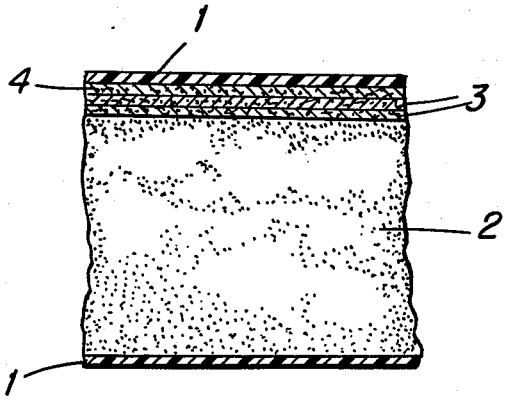
Figure 2

AID FOR KINDLING FIRES

BACKGROUND OF THE INVENTION

1. Field of the Invention

This invention relates to a device for facilitating the kindling of fires, such as charcoal or wood fires. More particularly, it relates to a safe, substantially non-volatile product for the kindling of recreational and cooking fires.

2. Description of the Prior Art

Camping and outdoor cooking, particularly backyard barbecues and cookouts, enjoy a high degree of popularity which is rapidly increasing as more and more people are introduced to the pleasantries of outdoor living and the gratifying experience of open-air cooking. An enjoyable outdoor cooking experience normally requires the use of a suitable cooking fire and, desirably, such a fire should be easily ignited and maintained.

Cooking fires are, of course, very common and methods of starting them date from antiquity. Given the requisite skill and sufficient time, any person can satisfactorily build and ignite a cooking fire. But in many instances people today have neither the time, the patience nor the proficiency required to gather suitable firewood and kindling, properly arrange and ignite them, and then build this into a fire of adequate proportions. So, oftentimes, other materials are used to get the fire started, materials which are more convenient and better suited to ignite charcoal, charcoal briquettes, artificial fireplace logs, etc.

One simple method is to crumple balls of paper, such as newsprint, pile the briquettes or whatever other material is being used around and on top of the crumpled paper and light the paper with a match. Hopefully, the burning paper will ignite some of the briquettes and they in turn will ignite the others. However, in practice, the paper may burn too quickly, not lasting long enough to raise the temperature of the briquettes to the ignition point. A slightly more sophisticated approach, and one which provides more reliable results, is to first build a fire with small pieces of kindling wood and then place the briquettes on top of the burning kindling. The wood lasts longer than burning paper and will suitably ignite the briquettes before burning out. Building such a fire, however, requires at least a modicum of skill and practice on the part of the practitioner and may entirely negate the convenience factor of using wood substitutes such as charcoal briquettes.

Another approach has been to use flammable liquid fuels, primarily petroleum naphtha, which when properly applied are allowed to permeate the briquettes or other combustible material before ignition. Upon ignition, the burning liquid fuel efficiently heats the briquettes or other material to ignition temperature and causes them to begin burning. Petroleum naphtha, however, has some very serious drawbacks in spite of its wide acceptance. Besides being convenient to use, it presents a safety hazard and is an unpleasant substance to handle. Being a highly volatile and extremely flammable liquid, it presents an explosion and fire hazard during storage and use. Additionally, because of its volatility, there is a rapid rate of evaporation and loss during use and before lighting.

Through the years various other materials have been used to kindle recreational and cooking fires. Thus, U.S. Pat. No. 617,424 (Pflaum, 1899) discloses a sheet of paper coated with wax which is useful for this purpose, and U.S. Pat. No. 1,113,478 (Phillips, 1914) teaches a plurality of tubes dipped in wax and having ends which are cut into a plurality of strips. Similarly, U.S. Pat. Nos. 3,297,420 (Klink, et al); 3,367,757 (Church) and 3,395,003 (Alexander) present variations on this same theme. Also, U.S. Pat. Nos. 2,548,379 (Lammerson), 2,965,096 (Barton), 3,317,290 (Gentry), and 3,385,282 (Lloyd) disclose various disposable cooking units which typically contain the charcoal and a firestarter, usually wax-impregnated paper, right within the unit. The entire package is ignited and consumed by the fire or, in some cases, the unburned container is thrown away after use.

U.S. Pat. No. 2,007,694 (Rutherford) discloses a different type of lighter which is essentially a block of wood pulp or other vegetable fibers which has been allowed to absorb melted wax until it became saturated and was then compressed to squeeze out the excess wax. The wax-saturated block thereafter has slots cut into it to facilitate air passage during burning. In use the block is ignited to produce a large flame which will effectively ignite coal, wood or other fuel in a stove or furnace. U.S. Pat. No. 3,279,900 (Naples) discloses a disposable package consisting of a container of combustible material which encloses a quantity of charcoal briquettes and an ignition device. The ignition device is a wood fiber base saturated with paraffin wax (the wax may constitute ten to twenty percent of the total weight of the device) and in which holes have been placed to provide air drafts for the fire. The entire package is placed in a suitable container, such as a barbecue grill, and the package ignited. The flame is communicated to the ignition device and from thence to the adjacent briquettes. A device of a different nature, which at one time was used by the military to heat canned field rations, consisted essentially of a box which was coated with wax having a relatively high melting point and filled with a mixture of lower melting wax and wood flour. In use the flaps of the box were lit and the fire thus communicated to the wax-wood flour composition. The higher melting wax served the dual purpose of water-proofing the box and preventing lower melting wax from escaping through the walls of the container while the food was heated above the box.

SUMMARY OF THE INVENTION

The present invention is an improved device for kindling fires in a confined area such as a charcoal grill, fireplace, or wood-burning stove. The device comprises a substantially solid core composition of wax and cellulosic particles in association with one or more layers of absorbant material adjacent to the core composition to take up any oily exudate from the wax. The core composition and absorbant material are enclosed within an ignitable, oil impervious container.

The package is placed on the fuel to be burned, for instance a mound of charcoal briquettes in a barbecue grill, and the edge of the container ignited with a match. As the container burns the flame is conveyed to the absorbant material and the core composition. If desired, a lighter strip comprising a material which is somewhat slower burning than the container or the absorbant material may be included in the package to convey the flame from the burning container to the core composition. Once the core is ignited, the burning wax produces sufficient heat to kindle the briquettes.

The cellulosic particles bind the wax in place so that it does not melt prematurely and run off the briquettes before burning, allowing the melting to take place in a controlled manner so that maximum kindling efficiency is realized.

BRIEF DESCRIPTION OF THE DRAWINGS

FIG. 1 is a perspective of one embodiment of the invention.

FIG. 2 is a vertical cross section of the embodiment of FIG. 1, as viewed along line 2—2 thereof.

DESCRIPTION OF PREFERRED EMBODIMENTS

FIG. 1 of the drawings illustrates a preferred embodiment of the present invention. The device is contained within and includes sealed overwrap 1, shown herein as being transparent to facilitate visualization of the entire device. The core of the device is the substantially solid block 2 which is comprised of a mixture of wax and cellulosic particles. Adjacent to block 2 are one or more layers of absorbant material 3 to take up, in sponge-like fashion, any oily material exuding from the wax component of block 1. Lighter strip 4, which is composed of a piece of slower burning sheet material than is absorbant material 3, is situated between the wrapper 1 and the block 2 and serves to aid in conveying a flame from the wrapper 1 to block 2 when the package is ignited by external means such as a match.

The wax component of block 2 may be any flammable hydrocarbon material commonly grouped within the general designation "wax." Preferred are the normally solid waxy distillate fractions of petroleum, such as paraffin and slack wax, but similar synthetic materials and waxy materials from other sources may be used. Likewise, naturally occuring and synthetic resinous substances may be used to advantage in place of the wax. The primary requirements of the wax or resin component are that it be substantially solid at ambient temperature (after blending with the cellulosic binder) and that it burn at sufficiently high a temperature to kindle a fire in the primary fuel (e.g. charcoal briquettes).

The cellulosic particles which provide the binder for the wax in block 2 may be any fibrous cellulose or celluloselike material or derivative thereof. Examples of suitable materials include vegetable fibers such as wood pulp, sawdust, cotton, paper pulp, ground nut hulls, and so forth. Wood fibers are preferred, either in the form of sawdust or pulp.

The components of block 2 are blended, for instance in a vat or conventional screw-type extruder, and the blocks formed in any suitable manner. Contemplated block forming techniques include extrusion, press-forming, and molding but other methods as well occur to those skilled in the art may be employed to advantage. The wax component should comprise the major portion of the block, preferably from about 50 percent up to about 90 percent by weight thereof, and most preferably from about 60 percent up to about 80 percent by weight, with the balance thereof substantially comprising said cellulosic particles. Various adjuvants may be incorporated into the composition without altering the essential nature of the block. Materials which enhance the burning of the wax, impart a pleasing scent, or tend to suppress undesirable smoking or odors are examples of adjuvants which may be desirably incorporated.

The absorbant material 3 serves to soak up any excess oil exuded by block 2, a condition particularly prevalent when slack wax or other relatively low grade wax or resin is utilized. This has the beneficial effect of entrapping the oil and preventing it from leaking out of the package, thereby avoiding an undesirable oily feel of the package when it is handled and preventing stains on the clothing of the user. Additionally, the separation of excess oil from the wax increases its melting point and allows the block to maintain its integrity during storage and use. The amount of absorbant material used in the device will depend upon the amount of excess oil in the wax or resin and also upon the absorption capacity of the absorbant.

Absorbant material 3 should be easily ignitable and is preferably in sheet form. Examples include, but are not limited to: porous papers such as paper towelling and tissue; paper products such as blotter paper; textiles such as strips of cotton cloth; coarsely matted fibers; and so forth.

The lighter strip 4 may be included in the package since frequently the container 1 and absorbant material 3 will burn too fast to convey the flame to block 2. Strip 4, therefore, should be easily ignitable but burn more slowly and/or with a hotter flame than container 1 and absorbant 3. Oil or wax coated paper or textiles will make suitable lighter strips to convey a flame from the burning container to ignite block 2. Other examples include paper or fibers impregnated with vegetable oils (such as corn, soybean, linseed, cotton seed, sunflower seed or castor oil), low vapor pressure hydrocarbons (e.g. polystyrene) or esters (dibutyl phathalate), sodium nitrate, gunpowder, nitrocellulose, etc.

Container 1 should provide an efficient barrier to any oil contained within the package and, additionally, be easily ignited with an ordinary match. It need not be of any particular configuration and may, indeed, be box-like, an overwrapping sheet or film (as in FIG. 1) with the ends heat-sealed, folded, sealed with an adhesive or twist-wrapped, or the container may even be formed by molding to a convenient shape. The form of the container will depend largely upon the material from which it is constructed, since the wide variety of suitable construction materials lend themselves to an equally wide variety of packaging techniques. Examples of contemplated packaging materials include: coated and uncoated papers; nitrocellulose; cellophane; nitrocellulose coated cellophane; plastic film; coated and uncoated textiles; coated and uncoated paperboard; expanded thermoformable plastic resins; molded paper pulp; and various combinations and laminates of these materials.

Although the present invention has been described with reference to particular embodiments and materials of construction, it is to be understood that modifications and variations may be resorted to without departing from the spirit of our invention, as those skilled in the art will readily understand. Such modifications and variations are considered to fall within the purview and scope of the appended claims.

We claim:

1. A fire kindling aid comprising:

(a) a substantially solid composition comprised of about 50 to about 90 percent by weight of wax and about 10 to about 50 percent by weight of cellulosic particles, based on the total weight of said composition;

(b) one or more layers of absorbant flammable material adjacent to said composition; and (c) a container enclosing said composition and said absorbant material, said container comprising a flammable, oil impervious packaging material.

2. A fire kindling aid comprising:

(a) a substantially solid composition comprised of about 50 to about 90 percent by weight of a normally solid combustible resinous material and about 10 to about 50 percent by weight of cellulosic particles, based on the total weight of said composition;

(b) one or more layers of absorbant flammable material adjacent to said composition; and (c) a container enclosing said composition and said absorbant material, said container comprising a flammable, oil impervious packaging material.

3. The fire kindling aid of claims 1 or 2 further comprising means within said container to convey combustion from said container to said solid composition when said container is ignited.

4. The fire kindling aid of claim 3 wherein said combustion conveying means comprises wax coated paper.

5. The fire kindling aid of claims 1 or 2 wherein said absorbant material is paper.

6. The fire kindling aid of claim 5 wherein said absorbant material is blotting paper.

7. The fire kindling aid of claims 1 or 2 wherein said container is constructed of combustible sheet material.

8. The fire kindling aid of claim 7 wherein said combustible sheet material is nitrocellulose coated cellophane.

9. The fire kindling aid of claims 1 or 2 wherein said container is constructed of molded combustible material.

* * * * *